United States Patent [19]

Bulso, Jr. et al.

[11] Patent Number: 4,535,618

[45] Date of Patent: Aug. 20, 1985

[54] SYSTEM, METHOD FOR FORMING CONTAINERS

[75] Inventors: Joseph D. Bulso, Jr., Canton; Stephen D. Doyle; James A. McClung, both of North Canton, all of Ohio

[73] Assignee: Redicon Corporation, Canton, Ohio

[21] Appl. No.: 633,472

[22] Filed: Jul. 23, 1984

Related U.S. Application Data

[62] Division of Ser. No. 444,789, Nov. 26, 1982, Pat. No. 4,483,172.

[51] Int. Cl.[3] ..... B21D 22/00

[52] U.S. Cl. ..... 72/349; 72/10; 72/405

[58] Field of Search ..... 72/4, 10, 12, 347, 348, 72/349, 34, 405

[56] References Cited

U.S. PATENT DOCUMENTS

| | | | |
|---|---|---|---|
| 2,426,390 | 8/1947 | Forest | 72/34 |
| 3,390,769 | 7/1968 | Tolham et al. | 72/16 |
| 3,902,347 | 9/1975 | Ridgway et al. | 72/336 |
| 3,980,297 | 9/1976 | Bulso, Jr. | 271/269 |
| 4,316,372 | 2/1982 | Veil | 72/4 |
| 4,414,887 | 11/1983 | Oril | 72/405 |

*Primary Examiner*—Leon Gilden

*Attorney, Agent, or Firm*—Reese Taylor

[57] ABSTRACT

A system for forming unitary containers from flat metal stock includes a unique arrangement of both previously known and newly discovered apparatus, including means for blanking and cupping the flat metal stock into individual cups; means for drawing and redrawing the cups and bottom profiling them in one machine; and additional means for trimming, flanging, and beading the containers thus drawn. The system and method include, among other things, the utilization of apparatus which permits drawing, redrawing, and bottom profiling to take place in one press. This is accomplished by carrying draw, redraw, and bottom profile tooling in a single press and by inserting the cups in the press for the draw operation and them removing them and reinserting them for the redraw and bottom profile operations. The apparatus which makes it possible to perform the method in this fashion includes draw tooling; a first accumulator/divider table for feeding cups into the press and into the draw tooling; redraw and bottom profiling tooling; further apparatus for transferring the drawn cups from the press to a second accumulator/divider table and back into the press for the redraw and bottom profile operations. A further unique feature of the present system and apparatus is the disposition of the draw and redraw tooling within the press in alternating, balanced condition so that, in cooperation with the second accumulator/divider table, the press is at all times provided with a balanced load.

2 Claims, 9 Drawing Figures

208
206
200
207
209
204a
203
204
202
201
202a
205b
205
205a
201a
C
54

SYSTEM, METHOD FOR FORMING CONTAINERS

This application is a division of application Ser. No. 444,789, filed Nov. 26, 1982 now U.S. Pat. No. 4,483,172.

FIELD OF THE INVENTION

This invention relates, in general, to forming the bodies of two-piece containers from flat metal stock and relates, in paticular, to a system, certain unique apparatus within the system and a method of operating the system wherein positive sidewall thickness control can be maintained while eliminating mechanical liftout and transfer and avoiding flange lock-out while producing improved bottom profile construction.

DESCRIPTION OF THE PRIOR ART

It has long been known that two-piece containers are preferable, for many reasons, in the food and beverage industry. It has also been long known that these containers can be formed from flat pieces of metal, or sheets, by various processes such as drawing, ironing, etc.

Generally speaking, the known apparatus for forming the body of a two-piece container by drawing and redrawing includes a series of apparatus such as a sheet feeder (see Bulso et al U.S. Pat. No. 3,980,297); a cupper; a draw-redraw press having a trim station; mechanical means for lifting the caps out of the die and then transferring the cups and containers from one station to another; and various flangers, beaders, testers, etc. This apparatus is usually arranged in a "line" so that the material passes from station to station for successive operations.

While this apparatus and system is essentially effective for the purposes for which it is designed, it is subject to some disadvantages.

One disadvantage is that the means of transfer from one station to another which is generally employed in the field is mechanical in nature involving apparatus of various designs, all of which have in common the feature of reaching into the press, grasping the container, and moving it from one station to the next. The difficulty is that there is a relatively high maintenance cost with mechanical transfer apparatus of this type and it is also subject to frequent breakdowns.

A second disadvantage of this type of transfer apparatus is that it is relatively slow. In other words, the overall speed of operation of the press and of the container production line as a whole is limited to the speed with which the transfer mechanism can operate. For obvious reasons, the press speed is controlled by the transfer mechanism speed because the press cannot reclose and perform its next operation until the container has been moved from its first station.

A third disadvantage is that mechanical, hydraulically or pneumatically liftout means are required to move the container out of the die into position for transfer. Here again the maintenance problem is significant as is the relative speed of operation.

Accordingly, the present invention is directed to a system, a method, and apparatus for eliminating the transfer and liftout mechanism and improving the overall function of the container line.

SUMMARY OF THE INVENTION

The present invention, as noted, relates to a method, a system, and an apparatus. Many of the system components and method steps are, admittedly, known in the art. It is believed, however, that the unique arrangement of the apparatus in the system is new in the art as is some of the apparatus.

Primarily, as far as the apparatus is concerned, it is believed that provision of a draw-redraw press, which also performs the bottom profile operation, is new. Heretofore, in the prior art, the raw material was cut and then fed through a draw-redraw press where, in a double action press, the first redraw was performed and following which the container was mechanically transferred to the tooling for performing the second redraw operation.

It has been found, however, that by providing both the draw and the redraw tooling in the same press and by providing for "through the die" operation, the first redraw can be performed and the container, with no flange on it, can be passed completely through the die onto a conveyor, from which it is moved to an accumulator/divider table where it is stored until it is returned to the press for operation of the second or redraw operation. In this way, the mechanical liftout and transfer of the prior art is eliminated and the only limitation on the speed of operation is the speed of the press.

In this way also, it has been found that the difficulties with breakdowns of the conventional mechanical liftout and transfer are eliminated and the maintenance costs are considerably reduced.

It is also a factor in the present system that the trimmer station is removed from the redraw die since the container is formed without a top flange, thereby eliminating the necessity for that step as well.

Finally, the concept of profiling the bottom in the second redraw station is believed to be new, particularly with regard to bottom profiling.

Accordingly then, production of an improved system, apparatus, and method for forming two-piece container bodies of the type above described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

This invention relates to an improved, highly efficient, low maintenance system for producing bodies for two-piece containers. It also relates to certain unique and novel apparatus which forms a part of the system and to a method of operating the system and apparatus.

SYSTEM

Figure 1:
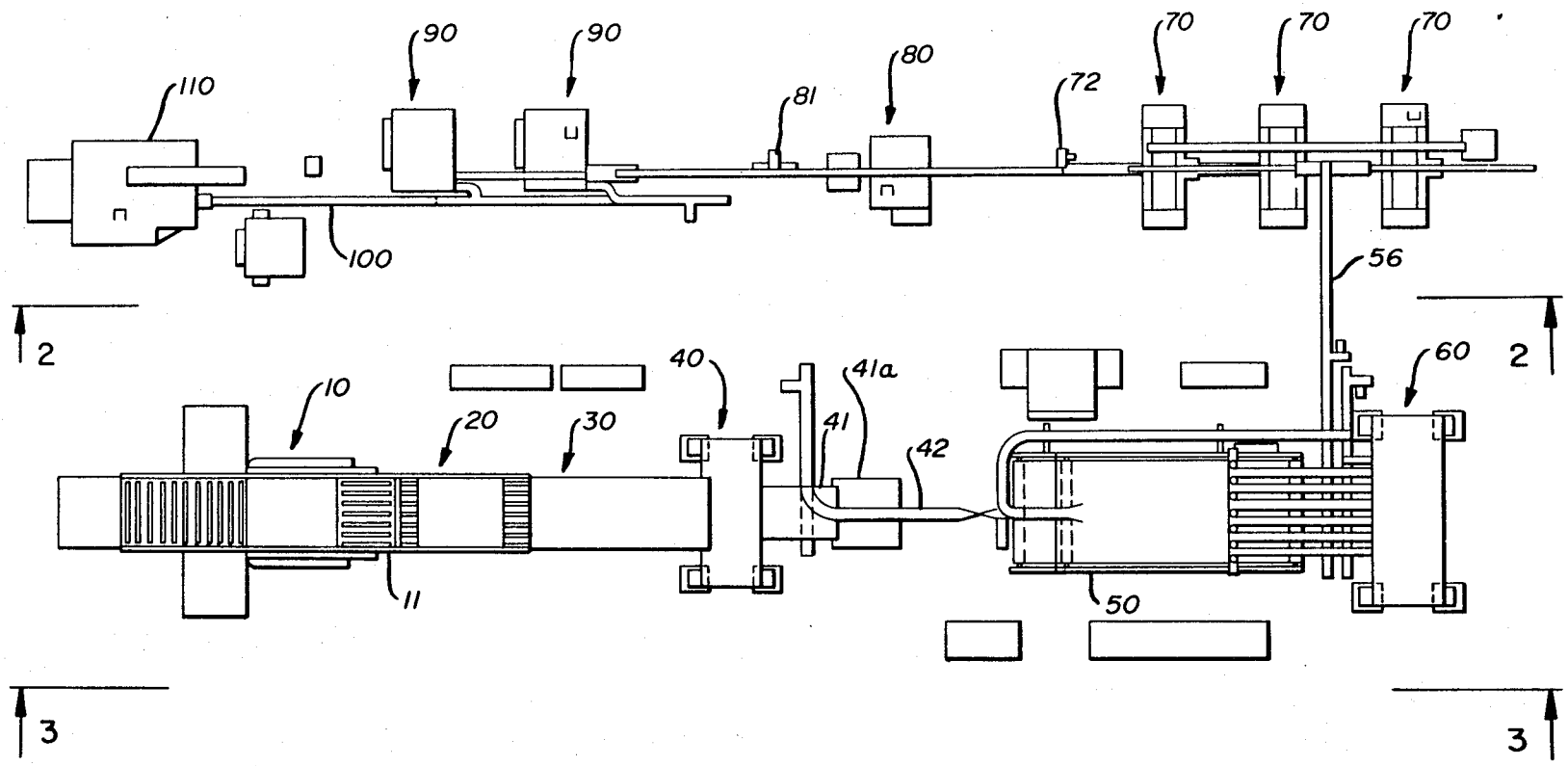
FIG. 1 is a plan view of the improved system.
Figure 2:
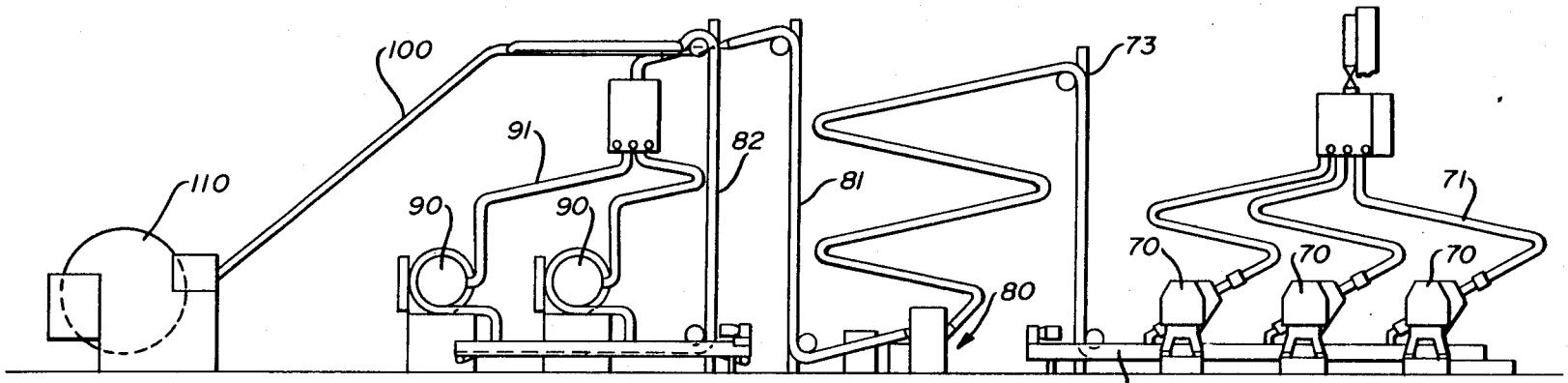
FIG. 2 is an elevational view taken along the line 2—2 of FIG. 1.
Figure 3:
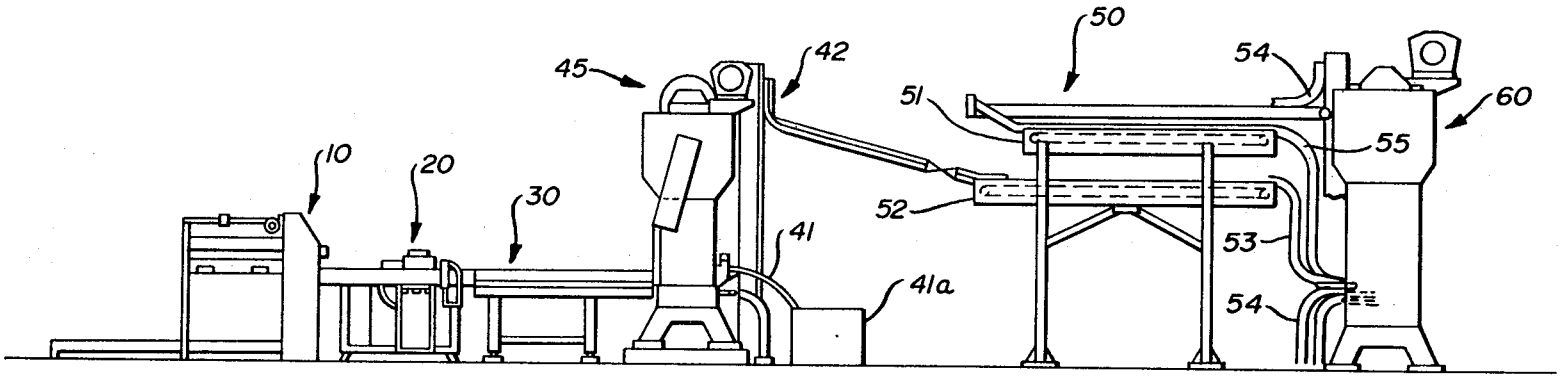
FIG. 3 is an elevational view taken along the line 3—3 of FIG. 1.

The overall system is generally illustrated in FIGS. 1 through 3 of the drawings. Therefore, the overall system, which involves a novel combination of known and new apparatus, and particularly the arrangement of that apparatus, will be described with reference being had, primarily, to those figures of the drawings.

Accordingly then, and referring to FIGS. 1 and 3, it will be noted that the system is arranged so that the metal stock enters the apparatus from the left side of the drawing figures and is first passed through a Dexter feeder 10 of a type which is well known in the art. Pre-cut sheets are loaded into the Dexter feeder 10 in known fashion and the Dexter is either mechanically or electronically connected to the cupper which will be subsequently described. In this regard, it should be noted that the form in which the stock is delivered to the overall system is not really overly pertinent and it could be supplied as either sheet or coil stock. It is, of course, however, necessary to transform that into sheets of the proper size for further operations within the press which can be done in known fashion.

Still referring to FIGS. 1 and 3 of the drawings, it will be noted that the Dexter feeder 10 is connected, by means of a conveyor 11, to a waxer or lubricator 20. The means for moving the sheets from the Dexter feeder 10 to the waxer 20 are known in the art and form no particular part of this invention, other than as integral components of the unique overall system arrangement.

From the waxer or lubricator 20, the material is then passed to a sheet feeder 30, an example of which is shown in Bulso et al U.S. Pat. No. 3,980,297. This apparatus will accurately feed the sheets, one at a time, into the cupper 40. The cupper 40 comprises a reciprocating press having tooling that is capable of blanking each sheet into discs and cupping the raw material from sheet form so as to really constitute the first step of a series of steps which transform the container from a flat piece of metal into a finished, cylindrical container body.

From the cupper 40, the material passes onto the conveyors 41 and 42. The conveyor 41 is a scrap ejector which transfers the blank scrap produced in cupper 40 to a scrap receptacle 41*a*. The conveyor 42 is really a combination doubling box elevator so that the cups are moved out of the cupper 40, up the trackwork of a vertical elevator, and then across a horizontal conveyor to the next station (see FIG. 3). Transfer mechanism of this general type is well known in the art and is not illustrated herein in great detail.

From the conveyor 42, the cups pass to the accumulator/divider tables which are generally indicated by the numeral 50 and include upper and lower tables 51 and 52. The cups are first received as lower table 52 and it will be understood tha the tables 51 and 52 serve as an orientation point prior to delivery of the cups to the draw-redraw press 60. In other words, the tables serve as a mass line flow link between cupper 40 and press 60 and allow press 60 to cycle using accumulated cups even when cupper 40 is momentarily deactivated. Also, the tables serve as a point for inspection and rejection of defective cups.

After such inspection has taken place and once sufficient cups C are accumulated, the lower table 52 divides the cups into lanes and gravity feeds the cups, by means of the conveyor 53, into the double acting draw-redraw press 60. This press, which is illustrated in FIGS. 4 through 9 of the drawings, will be described in greater detail below. Suffice it to say here, however, that the draw-redraw press 60 carries die sets capable of successively drawing and redrawing the cups to the desired finished dimensions.

It will be understood, however, that this is a "through the die" type operation and therefore the cups first pass into the draw-redraw press 60 from the lower table 52 and are directed to the die sets which perform the draw operation. After they have been drawn, they are then passed on through the die and onto the conveyor 55 and back to the upper table 51.

Table 51 performs functions similar to table 52, i.e., inspection, removal of defective pieces, orientation, and accumulation. It also should be noted that during this time the container is out of the press and cooling down, which enhances further operations.

From the table 51, the containers are then gravity fed back into the press 60 on conveyor 54 so as to permit the redraw die set to operate on them. As noted, the detail of this operation and the apparatus necessary to its performance will be described more specifically below.

For purposes of reviewing the general system, however, it is sufficient to note that after the just mentioned redraw operation, the drawn and redrawn containers will exit from the redraw press 60 to the conveyor 56 (see FIG. 1).

Referring again to FIGS. 1 and 2 of the drawings in particular, it will be noted that the doubling box conveyor 55, which is similar to conveyor 42, esssentially interconnects the apparatus just described with a second conveyor 56 which leads to a second series of apparatus usually arranged in parallel relationship with the first.

Thus, it will be seen that the conveyor 56 communicates between the press 60 and infeed conveyors 71 of the trimmers 70. These are rotary trimmers which can be of any conventional construction or design. Accordingly, as the drawn and redrawn containers are fed into the trimmers 70 by means of the infeed conveyors 71, they are then appropriately trimmed as required. It will be noted, however, that the trimming operation occurs outside the press 60 in this system. This provides improved quality and lower machine maintenance and also avoids flange lock out or wrinkles and thus results in fewer rejected containers.

The containers then pass out of the trimmers 70 onto discharge conveyors 72 and 73. This is essentially another elevator-conveyor combination of the types already referred to with regard to the conveyors 41, 42, and 55,56.

The trimmed containers then pass, by means of the elevator-conveyor 73, into the spin flanger 80, at which time a flange is formed on the upper edge of each container. Once the flanging operation has been completed, the containers are passed onto the elevator-conveyor 81 which in turn passes them onto the beaders 90. Once the beading operation has been completed, the containers are moved to the elevator-conveyor 82, which essentially is a discharge elevator, and then moved to a conveyor arrangement 100 which feeds into an air tester 110 and ultimately to a palletizer.

In this fashion, a container is completely formed in the unique system starting with the blank stock at the Dexter feeder 10 and finishing with the formed container exiting at the air tester 110.

APPARATUS

With regard to some of the specific apparatus employed in carrying out the invention, attention is directed to FIGS. 4 through 9 of the drawings. While the system is believed to be unique in its arrangement of components, some of the apparatus employed is also considered novel.

Figure 4:
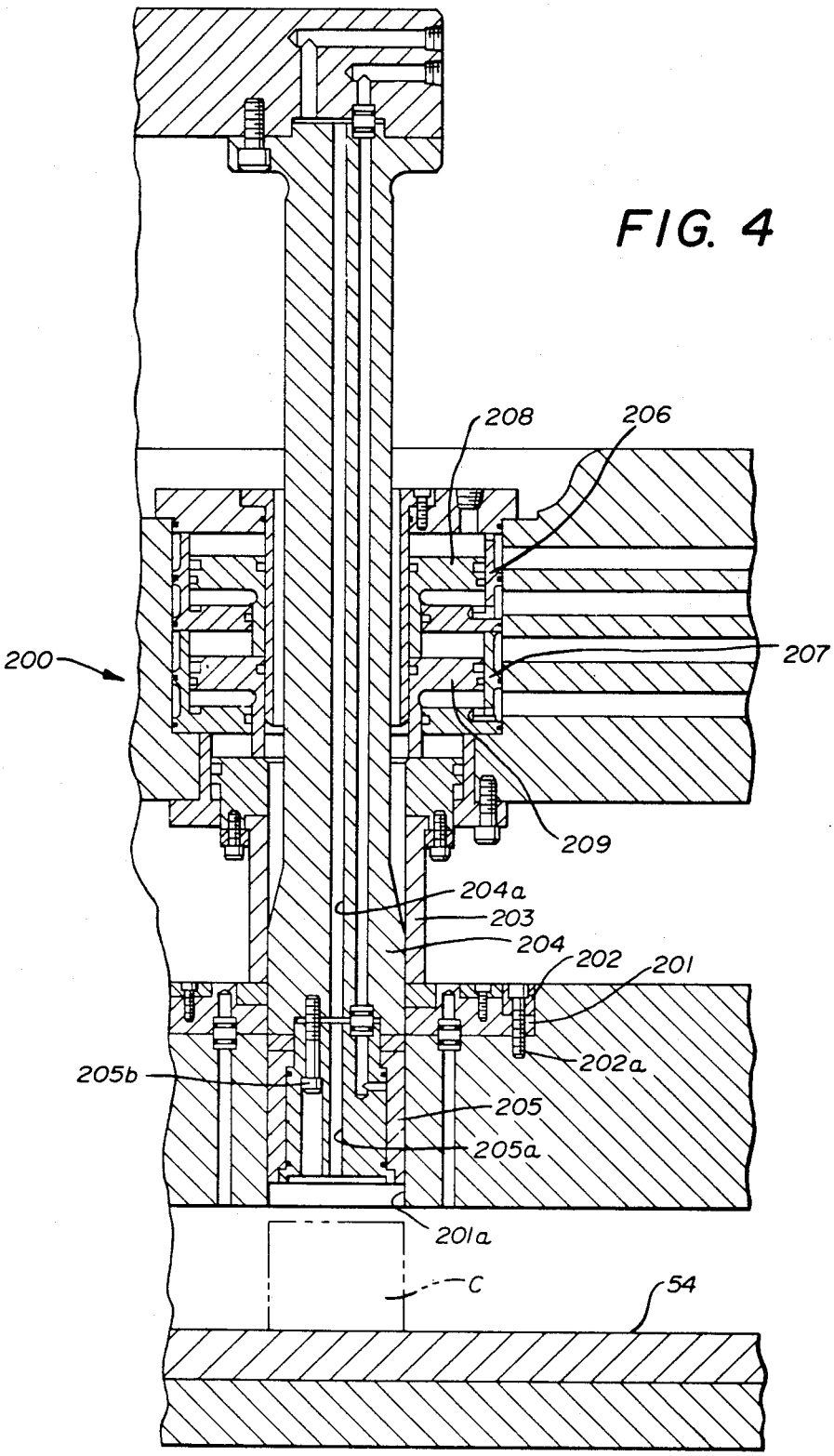
FIG. 4 is a partial, elevational view showing the apparatus for making the first draw.

Referring next then to FIG. 4, it will be noted that this essentially illustrates the die set capable of performing the first redraw of the container in the draw-redraw press 60. The press will normally be of the double acting type, an example of which is shown in Ridgeway U.S. Pat. No. 3,902,347. The specific tooling carried by the press is generally indicated by the numeral 200 and includes the die 201 and retainer ring 202 which is secured to the bottom bolster of the press by a plurality of screws 202*a*. This is a female die and is intended to cooperate with a punch 205 carried by the inner punch holder of the press. The outer punch holder of the press also carries a pressure sleeve 203 for hold down purposes. The riser 204 and punch 205, which is secured to the lower end of the riser by the screw 205*b*, are, as noted, carried by the inner punch holder.

An upper cylinder 206 and lower cylinder 207 are located in the outer punch holder to receive pistons 208 and 209 which act on the pressure sleeve 203 under pneumatic or hydraulic pressure for hold down purposes. Essentially the pressure sleeve descends as the press descends and engages the bottom of the cup to hold it in place while the punch 205, which is carried by the inner punch holder and passes through the pressure sleeve, is forced downward to form the container or, in other words, to perform the first redraw or draw of the container.

It will also be noted that the die 201 has a trough bore 201*a* therein. In this fashion, once the draw has taken place and when the punch 205 is being retracted with the inner punch holder, the pressure sleeve 203 is also retracted. The punch 205 is formed with a through central bore 205*a* which leads to a communicating bore 204*a* in riser 204 which, in turn, communicates with a source of air. Also, punch 205 tapers slightly toward its lower end. These two features allow the container C to be removed from the punch and deposited onto conveyor 54 which leads back to the upper accumulator table 51 where the containers are accumulated and retained, as described above, until such time as they are returned to the press 60 for the second redraw.

Figure 8:
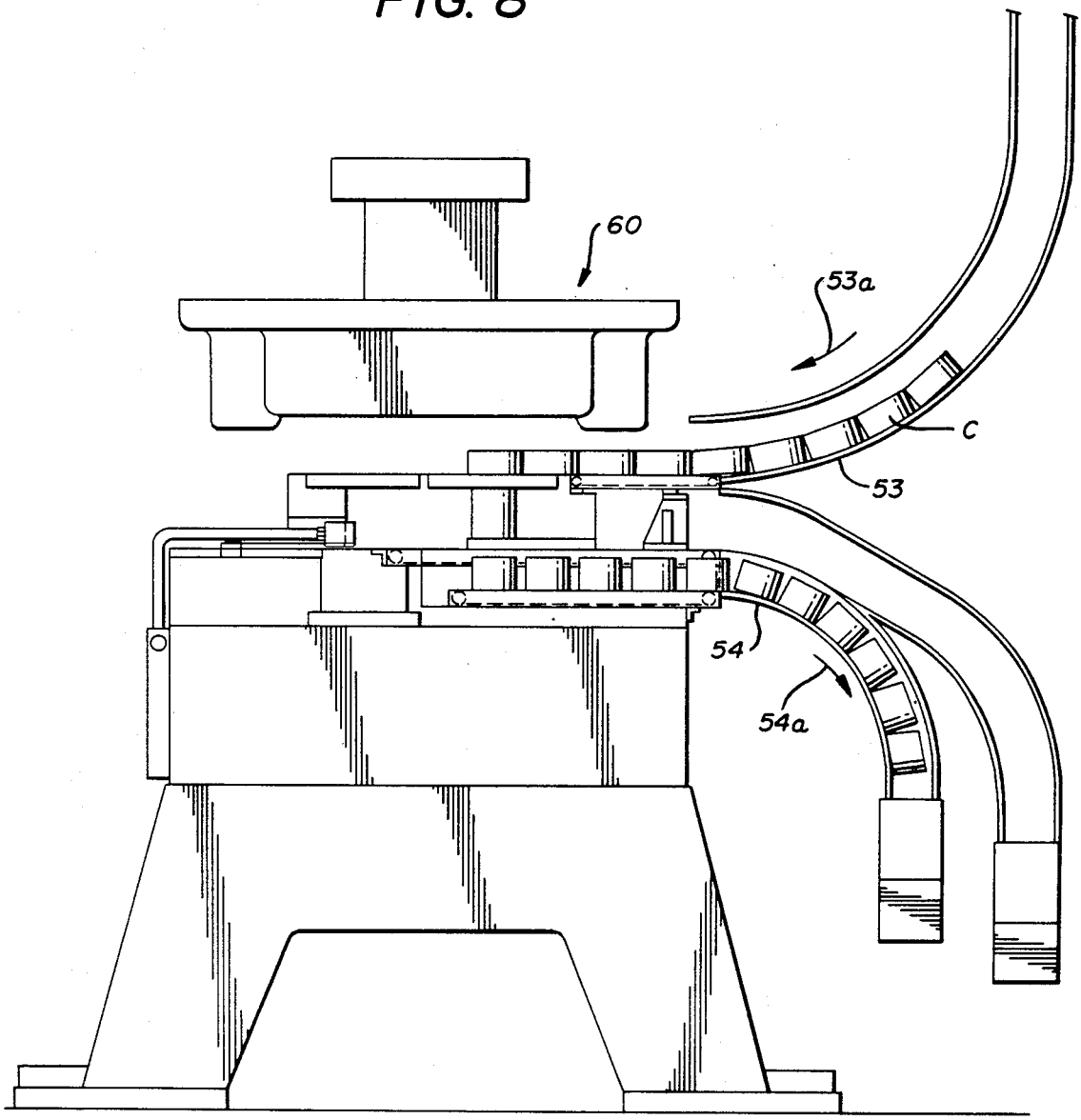
FIG. 8 is an elevational view of the draw-redraw press illustrating the first draw operation.

Reference to FIG. 8 of the drawings illustrates the manner in which the conveyor system cooperates with the press 60 and lower table 52. It will be seen how the cups C move on conveyor 53 into the press 60 in the direction of arrow 53*a* so that they can be drawn by tooling 200 and then pass "through the die" onto conveyor 54 for transportation to upper table 51 in the direction of arrow 54*a* for accumulation and retention prior to further operations. This "through the die" arrangement eliminates the mechanical liftout and transfer means common to the prior art.

Figure 5:
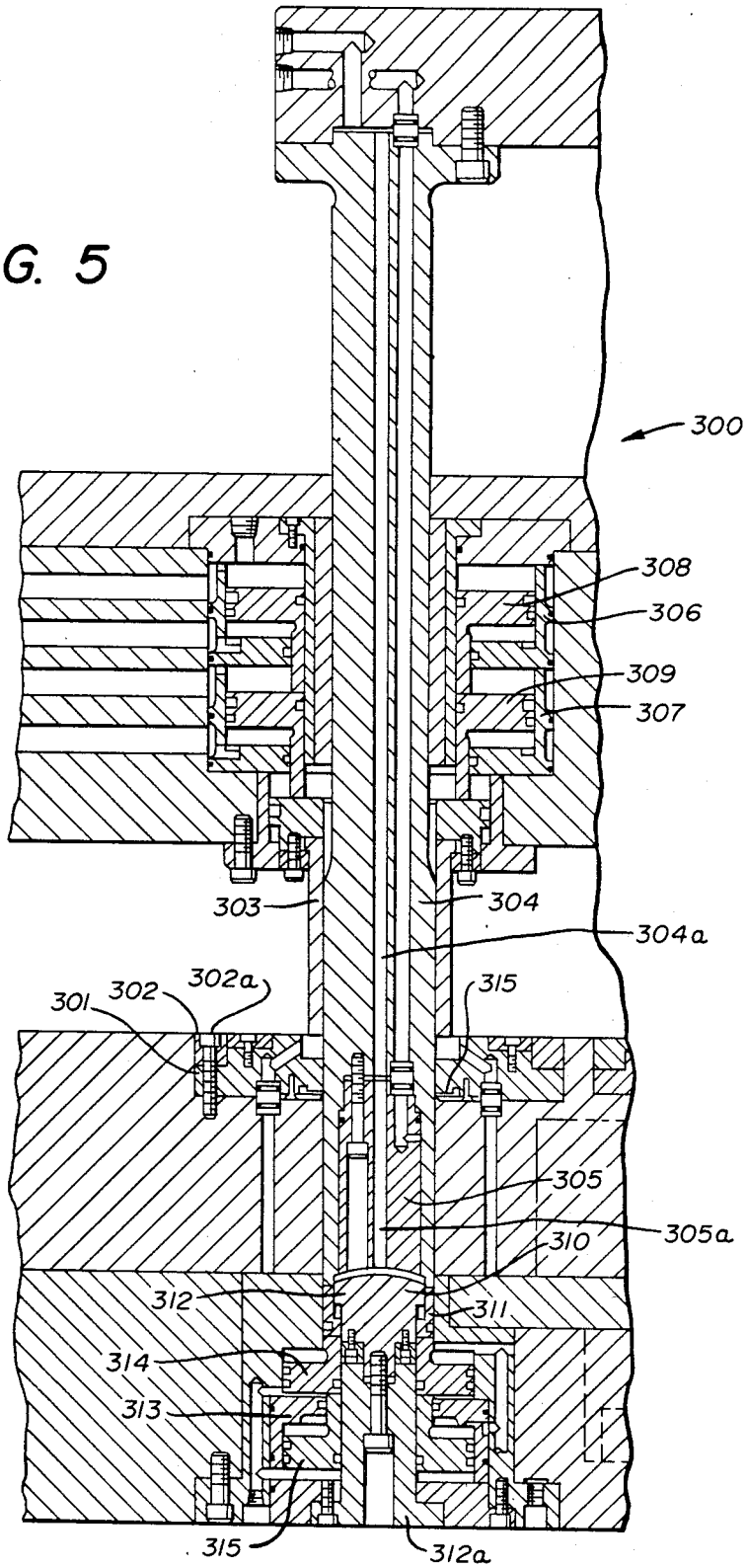
FIG. 5 is an elevational view, partially in section, showing the apparatus for making the second draw or redraw.
Figure 6:
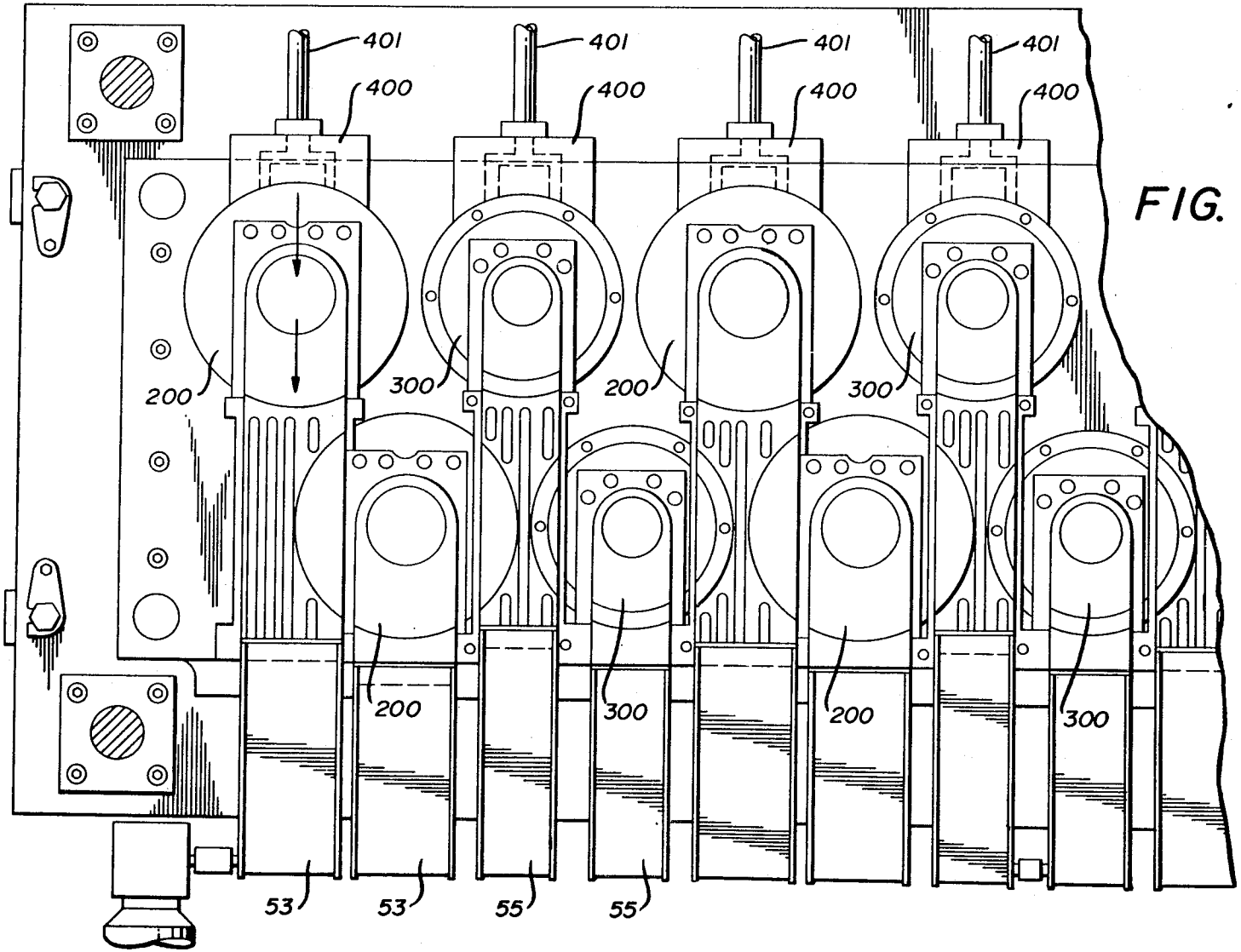
FIG. 6 is a partial plan view of the die set for the draw and redraw operations.
Figure 7:
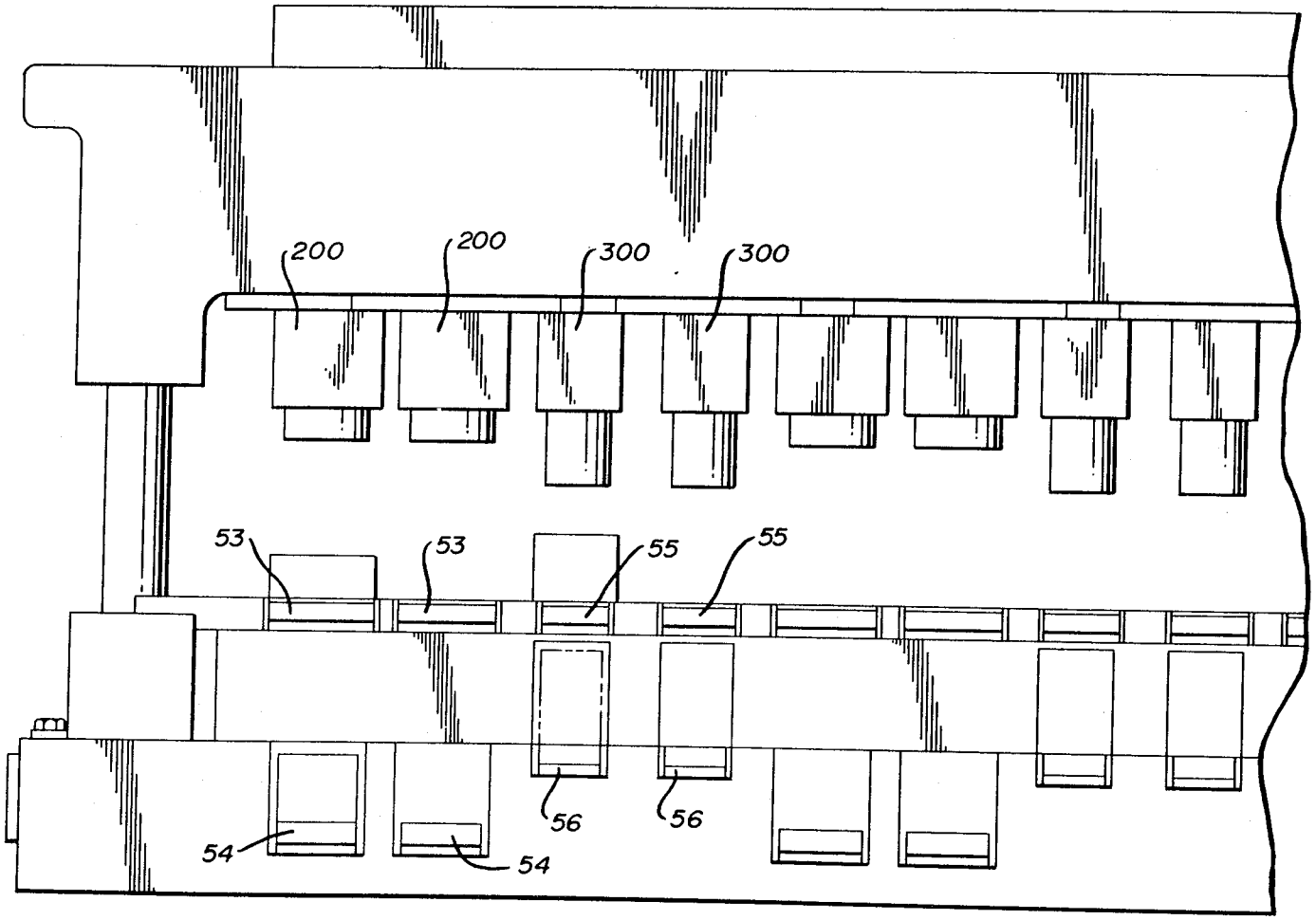
FIG. 7 is a partially schematic, elevational view of the die set and press for making the draw and redraw.

Attention is now directed to FIG. 5 of the drawings wherein the tooling for performing the second redraw is illustrated and generally indicated by the numeral 300.

This tooling, of course, is carried in the same press 60 and the particular relative physical arrangement of the tooling of FIGS. 4 and 5 within the press will be described subsequently.

For present purposes, however, and specifically referring to the second redraw tooling illustrated in FIG. 5, it will be noted that again a die 301 is employed and is held onto the bottom bolster of the press by the die ring 302 and a plurality of screws 302*a*.

The inner punch holder of the press 60 carries a riser 304 and a punch 305. A pressure sleeve 303 is carried on the outer punch holder.

The redraw operation is accomplished somewhat similarly to the draw or "first redraw" operation. Thus, the pressure sleeve 303 is operated on by pistons 308 and 309, which are carried in the upper and lower cylinders 306 and 307 of the outer punch holder. The sleeve 303 descends to engage the bottom of the drawn container C and hold it in place so that the riser and punch, which descend with the inner punch holder, can perform the redraw operation.

Figure 9:
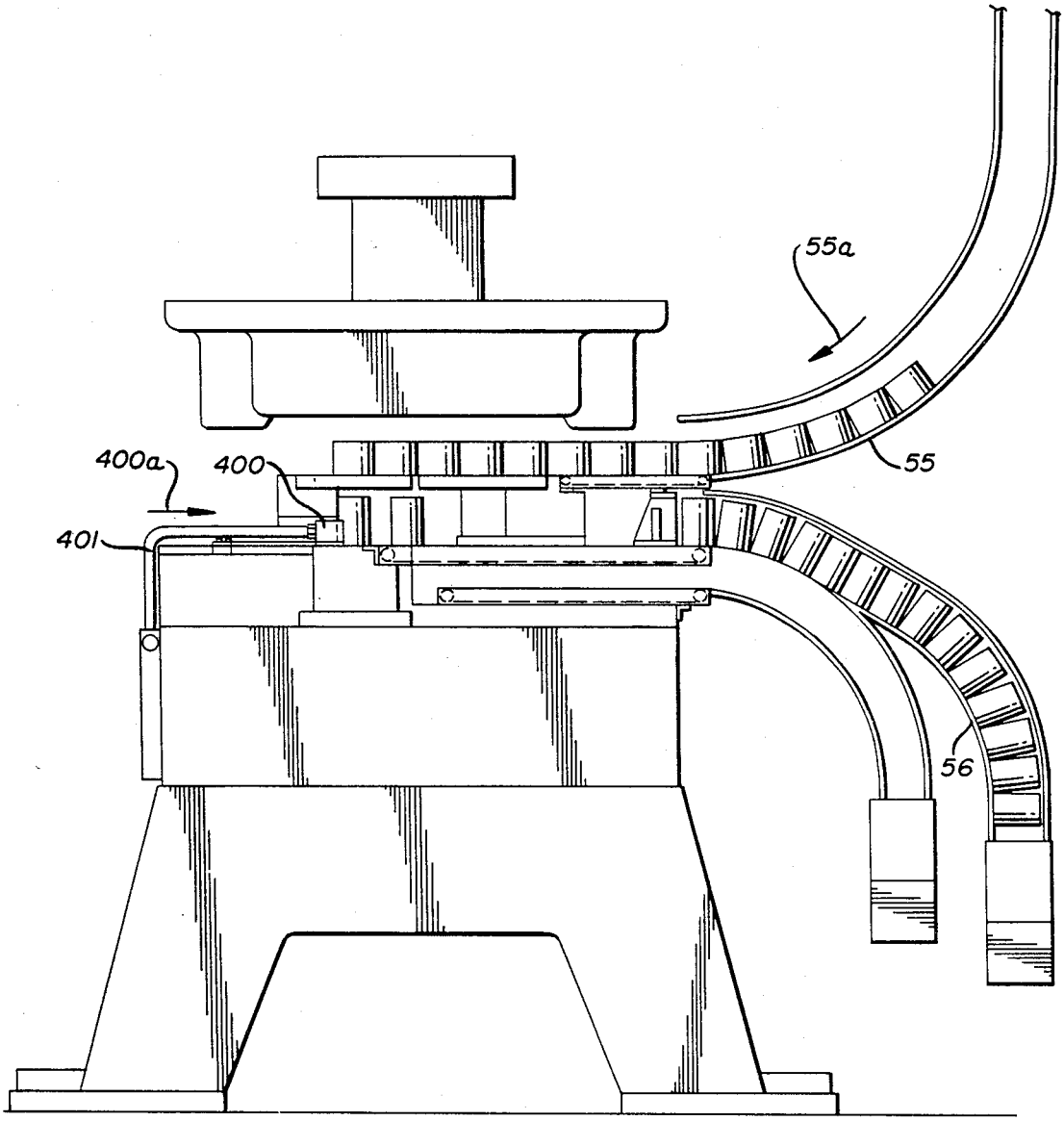
FIG. 9 is an elevational view of the draw-redraw press illustrating the redraw operation.

Reference to FIG. 9 of the drawings illustrates the cooperation of the conveyor system and upper table 51 with the press. As noted, the drawn containers pass out of the press onto conveyor 54 and thus to upper table 51. After the inspection, orientation and accumulation functions are performed and the containers are fed back into press 60 by conveyor 55 in the direction of arrow 55*a* whereupon the redraw takes place as just described. The containers are then moved onto conveyor 56 and out of the press.

It ought to be noted, however, that a still further operation is performed in a unique fashion at the second redraw station.

Specifically, the bottom of the container C is profiled by a reverse draw accomplished by utilization of profile pad 310 and pressure pad 311. The container is held between punch 305 and pad 311. It will be noted that punch 305 has a concave bottom so that the container is held between the periphery of punch 305 and the pad 311.

As the punch 305, which has just redrawn the container C continues its descent with the inner punch holder, it picks up pad 311 for holding purposes. Pad 311 works as a pressure sleeve similar to sleeve 303 and is controlled by pistons 314 and 315 operating within cylinder 313.

The container thus held is forced onto the top of the profile pad 312 which is fixed on riser 312*a*.

In this way, the container is reverse drawn and the metal flows about the radius of pad 311.

After the bottom is profiled, the inner punch holder lifts off and container C is stripped from punch 305 by air passing through bore 305*a* in the punch and 304*a* in the riser although mechanical strippers 315 can be provided for insurance if desired.

In order to move the redrawn container onto exit conveyor 56, a "blow out" apparatus is employed. Referring to FIG. 9 it will be seen that a nozzle 400 which is connected by a suitable conduit 401 leading to a source of pressurized air (not shown). This air, when applied in the direction of arrow 400*a* will blow the containers onto conveyor 56 whereupon they can be removed from press 60 for further operations. Only one nozzle 400 is illustrated although one would be associated with each set of redraw tooling 300. Here again, mechanical liftout and transfer with its attendant disadvantages is avoided.

The present invention also includes a further feature which enhances its efficiency and reliability. Thus, particular attention should be given to FIGS. 6 and 7 of the drawings which illustrate the arrangement of the first redraw and second redraw die sets within the press 60.

It will be noted that an even number of die sets are contained in the press. Half of these will be tooling 200, capable of performing the first redraw and passing the redrawn container C on to the conveyor 54 and out of the press.

The remaining half will contain the apparatus necessary to perform the second redraw as indicated by the numeral 300 in FIG. 5. This tooling 300, of course, will receive the redrawn containers when they pass back into the press. It is important, however, to note that at all times the press will have a balanced load. In other words, assuming an initial start up operation, the cups from the cupper 40 will only be passed into the press in sufficient number and in a sufficient spacing and direction to occupy each of the tooling sets 200 for the first redraw. The second redraw tooling 300 will be empty and will not perform any function. Due to the symmetrical arrangement of the tooling 200 and 300, the press will, in fact, have a balanced load at that time. Thus, the tooling is arranged so that there are an equal number of first and second redraw tooling (200 and 300) stations spaced and located from front to rear and from side to side.

Once a full complement of containers have been subjected to the first redraw and removed from the press, a second quantity of cups will enter the press and the draw operation repeated. On the next sequence, however, a quantity of containers which have been subjected to the first redraw will also enter the press and will occupy each of the tooling sets 300. In this fashion again, due to the number of the forming stations and their symmetrical arrangement, the press 60 again will have a balanced load with all stations 200 and 300 full.

The accumulator/divider table 51 insures that no drawn containers will be returned to the press for the second redraw until there are a sufficient number of acceptable containers to occupy all of the second redraw stations 300. In this way, the press will either run with a full complement at all of the stations 200 and 300, or will run only with either stations 200 or 300 full. Again, the balancing of the loading of the press is uniquely assured with this system and such balancing is important to the operation of a high speed, high efficiency press.

It is also believed unique and should be noted that it is not generally known in the art to take containers into a press, perform an operation on them, take them out of the press, and then return them to the same press for a second operation.

While a full and complete description of the invention has been set forth in accordance with the dictates of the Patent Statutes, it should be understood that modifications could be resorted to without departing from the spirit hereof or the scope of the appended claims.

For example, in describing the system, the apparatus 10, 20, 30, 40, 50, and 60 is illustrated and described as being disposed in parallel relationship with apparatus 70, 80, 90, and 100. These lines could also be arranged in end to end relationship if desired or necessitated by the dimensions or configuration of the building in which they are installed.

What is claimed is:

1. A method of forming containers from flat metal stock, comprising the steps of:

(A) blanking and cupping the metal to form a cup;

(B) drawing, redrawing, and bottom profiling the cup into a container in a single press; including:

(1) inserting the cup into the press and drawing it, (2) removing the drawn cup from the press to an accumulator/divider table for orientation and inspection;

(3) reinserting the drawn cup into the press and (4) redrawing and bottom profiling it into a container; and (5) removing the container from the press;

(C) trimming the drawn and redrawn container;

(D) flanging the drawn and redrawn container; and (E) beading the container.

2. The method of claim 1 wherein equal numbers of cups and drawn containers are inserted into the press at any given time for drawing and redrawing.

* * * * *